US005265291A

United States Patent [19]

Callaway

[11] Patent Number: 5,265,291

[45] Date of Patent: Nov. 30, 1993

[54] BOX SPRING CORNER SUPPORT

[75] Inventor: Milton C. A. Callaway, Dahlonega, Ga.

[73] Assignee: Simmons Company, Atlanta, Ga.

[21] Appl. No.: 934,206

[22] Filed: Aug. 21, 1992

Related U.S. Application Data

[62] Division of Ser. No. 781,347, Oct. 22, 1991, Pat. No. 5,165,125.

[51] Int. Cl.[5] ..... A47C 23/00

[52] U.S. Cl. ..... 5/254; 5/260; 5/261; 267/97

[58] Field of Search ..... 5/246, 252, 253, 254, 5/260, 261, 474, 476; 207/98, 103, 105, 110

[56] References Cited

U.S. PATENT DOCUMENTS

| | | | |
|---|---|---|---|
| 2,954,075 | 9/1960 | Repaich | 5/260 |
| 3,406,411 | 10/1968 | La Reis | 5/474 |
| 3,653,081 | 4/1972 | Davis | 5/260 X |
| 3,824,639 | 7/1974 | Mandusky | 5/260 |
| 4,207,634 | 6/1980 | Kitchen et al. | 5/260 X |
| 4,452,438 | 6/1984 | Hancock et al. | 5/476 X |
| 4,559,654 | 12/1985 | Mizelle | 5/261 X |
| 4,796,872 | 1/1989 | Hagemeister | 267/110 X |

*Primary Examiner*—Michael F. Trettel
*Attorney, Agent, or Firm*—Jones & Askew

[57] ABSTRACT

An improved spring is provided which may be used in cushions, mattresses, or box springs which includes a limiting internal member. This limiting member assist in limiting the longitudinal deflection of the springs. Also provided are snapped-fitting connections between the spring and a grid for use within a box spring. Also provided is a "floating" portion of a peripheral border wire, particularly suitable for use in a pair of box springs beneath a king-size mattress unit. Also provided is a corner guard which provided support for upholstered fabric on a box spring. Finally, an improved border-wireless mattress using a peripheral band is provided, which allows the mattress to bend more easily, without disadvantageous setting of its border wires.

5 Claims, 11 Drawing Sheets

BOX SPRING CORNER SUPPORT

This is a division of application Ser. No. 781,347, filed Oct. 22, 1991 now U.S. Pat. No. 5,165,125.

TECHNICAL FIELD

This invention relates in general to bedding, in particular mattresses and box springs. The invention is directed toward a spring which may be used in cushions, mattresses or box springs, which includes a internal limiting member which assists in limiting the longitudinal compression of the springs, which in one embodiment are plastic. The invention is also directed toward a plurality of springs attached in a snap-fitting relationship to a grid including a plurality of rods in a crisscross relationship. The invention is also directed toward a deflectable peripheral border wire, which is especially suitable for use in a king-size mattress environment. The invention is also directed toward a corner member which provides support for a covering thereon, and may include a plaited section allowing for its deformation. Finally, the invention provides an improved borderwireless mattress using a flexible peripheral band, which allows for bending of the mattress without disadvantageous setting of its border wires.

BACKGROUND OF THE INVENTION

Mattresses and box springs have been known in the art for many years. Typically, a mattress is configured to directly support a person or persons, with the box spring being positioned beneath the mattress and above a supporting frame, foundation, or supporting surface. The box spring provides additional cushioning and support underneath the mattresses and may include a variety of springs within its interior.

U.S. Pat. No. 3,276,048 to Beckman, entitled "Spring Assembly", discloses a plurality of bellowed springs 14, which may or may not be intermeshed when in position. These springs may include a hole 42, which is configured to fit over loops 30 of rod elements 24, such that the springs may be attached as shown in FIG. 5.

U.S. Pat. No. 3,766,580 to Curtis, entitled "Plastic Spring Assembly Connected to Wire Frame", discloses corrugated plastic springs substituted for metal coil springs. The bottom of the springs are provided with spaced apart "wire retaining means" for connecting the springs to the wires. The retaining means are so located that the wires, which have been constructed perpendicular to each other, are bent out of a perpendicular relationship and impart opposite rotational forces on the spring, providing for a secure connection therebetween.

U.S. Pat. No. 3,433,012 to Zalicovitz, entitled "Resilient Constructions for Use in Furniture", discloses tubular constructions constructed out of a flexible, relatively stiff, nonmetalic sheet material such as paper, cardboard or synthetic plastics. These tubes are preferably of relatively short length, and have two opposite substantially flat sides, the connected sides being provided with creases or lines of fold material parallel to the flat sides, which may be referred to as "plaited".

U.S. Pat. No. 2,979,739 to Krakauer, entitled "Mattress, Cushion or the Like", discloses a mattress construction which may include springs 32 (see FIG. 8), of a suitable light-space weight resilient and flexible synthetic plastic material of the requisite thickness and shape to provide support under the pressure of the body of a mattress user. In reference to FIGS. 3-6, an interconnection is provided with an intermediate wire spring 23 and an upper and lower support members 10, 12.

U.S. Pat. No. 2,150,747 to Naulty, entitled "Cushion", discloses tubular, resilient columns 7, which includes (as shown in FIG. 3) integral diaphragms 12, provided as reinforcement.

U.S. Pat. No. 4,736,932 to Haslim, entitled "Segmented Tubular Cushion Springs and Spring Assembly", discloses tubular spring members, which may be made of plastic materials, used seat cushions.

Although the above documents disclose configurations which have benefits in their own right, they nevertheless exhibit shortcomings which are satisfied by that identified in the present description.

SUMMARY OF THE INVENTION

It is an object of the present invention to provide an improved spring for use in a mattress, box spring, cushion or other supporting structure.

It is a further object of the present invention to provide an improved spring for use in a mattress, box spring, cushion or other supporting structure, which includes a deflection limiting feature.

It is a further object of the present invention to provide an improved spring for use in a mattress, box spring, or other supporting structure, which may be attached along with other springs to a grid.

It is a further object of the present invention to provide an improved box spring having a deflectable or "floating" edge.

It is a further object of the present invention to provide an improved box spring having a deflectable or "floating" edge, which when used in conjunction with a second box spring to support a single king size mattress, reduces the feel of a center "ridge" in the mattress which may be exhibited by the two abutting edges of the box springs.

It is a further object of the present invention to provide a corner member which provides integrity to the corners of box spring or other units, and which, in some embodiments, be deformable.

It is a further object of the present invention to provide a borderwireless mattress including a peripheral band.

Other objects, features, and advantages of the present invention will become apparent upon reading the following detailed description of the preferred embodiment of the invention when taken in conjunction with the drawings and the appended claims.

DETAILED DESCRIPTION OF THE PREFERRED EMBODIMENT

The Spring

Figure 1:
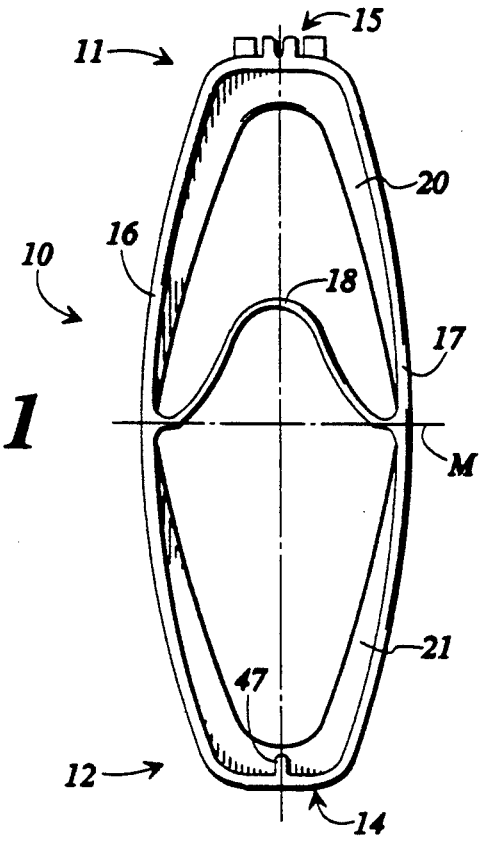
FIG. 1 is a side plan view of a spring according to the present invention including a first snap-fit configuration.

Referring now to FIG. 1, a spring member 10 is shown. The spring member 10 includes an upper end 11 and a lower end 12. The lower end 12 defines a lower supporting surface 14 which is configured to be positioned atop a wood frame or other supporting member as discussed in further detail later in this application. The upper end 11 includes a first snap-fit configuration 15 configured to attach the spring 10 to a grid as described later in further detail.

The spring member 12 also includes a pair of side walls 16, 17. Intermediate the side walls of the spring member 10 is positioned a limiting membrane 18. The limiting membrane 18 is not straight in the preferred embodiment, but includes at least one bend. With respect to the configuration shown in FIG. 1, this membrane 18 extends inwardly and sidewardly relative to one side wall 16 of the spring, turns upwardly, then downwardly, and then attaches to the opposite side wall 17 of the spring.

The spring 10 also includes a pair of upper and lower flanges 20, 21 for structural rigidity. The upper flange 20 extends from approximately the center of one side wall 16, upwardly toward the upper end of the spring, then downwardly toward the center of the other side wall 17, to terminate there. The lower flange 21 extends from approximately the center of one side wall, downwardly toward the lower end of the spring, then upwardly toward the center of the other side wall, to terminate there.

Figure 2:
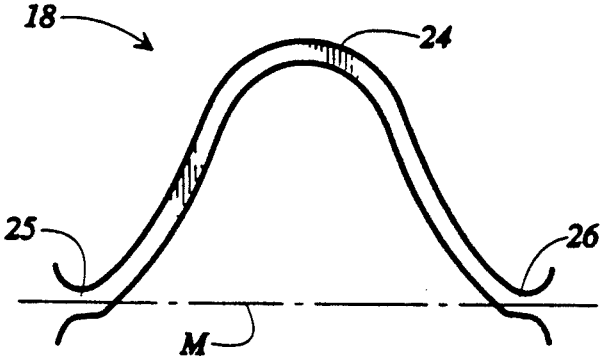
FIG. 2 is an isolated view of a limiting member included in the spring of FIG. 2.

Referring now to FIG. 2, the limiting membrane 18 of the spring 20 of FIG. 1 is shown in further detail. The membrane 18 may be understood to include a center portion 24 attached at each end at 25, 26 to a corresponding side wall of the spring. An axis M extends through the ends 25, 26 of said membrane, but at least a portion of said center portion 24 does not lie along said axis M. As discussed below, this is to allow a certain degree of "slack" to be taken out of the membrane as the spring 10 is compressed and the side walls separate.

Alternate Membranes

Referring now to FIGS. 14–21, alternate limiting membranes are illustrated. It may be understood that each of these membranes includes some type of bend, in order to allow some slack in the membrane to be taken up during spring compression.

Figure 25:
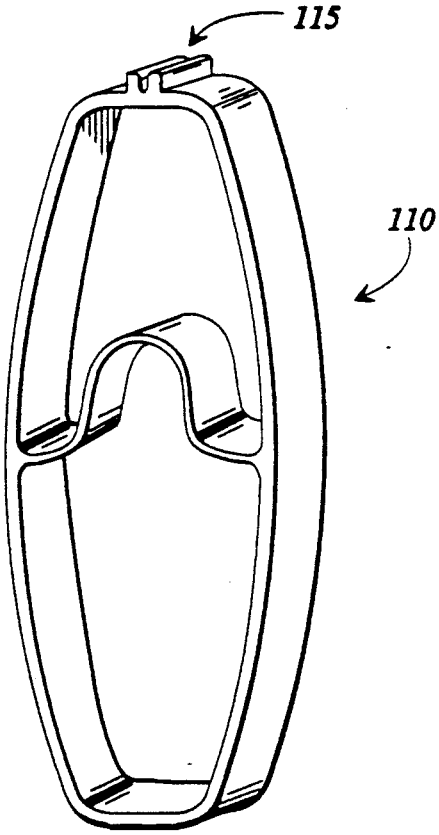
FIG. 25 is an isolated pictorial view of an extruded spring according to the present invention.

In the configurations shown in FIG. 2, FIGS. 14–19, and FIG. 21, the membranes are injection molded plastic, being molded in a unitary fashion along with the rest of the spring. In the configuration shown in FIG. 20, the membrane is a steel tension spring separable from the rest of the spring. In the spring 110 shown in FIG. 25, the spring is cut from an extruded member along a transverse slice line, such that the side walls of the spring have the same depth as its membrane. The attachment portion 115 of the spring 110 may include additional post-slicing machining.

Operation of Spring

As discussed in further detail below, the upper end of the spring 10 shown in FIG. 1 is attached to a grid which transfers force downwardly onto the spring 10 (along with other springs). This force causes the spring to be compressed along its compression axis S, such that the side walls 16, 17, are separated. As they separate, the limiting membrane tends to straighten out and to resist separation of the walls.

The Spring and the Grid

Figure 3:
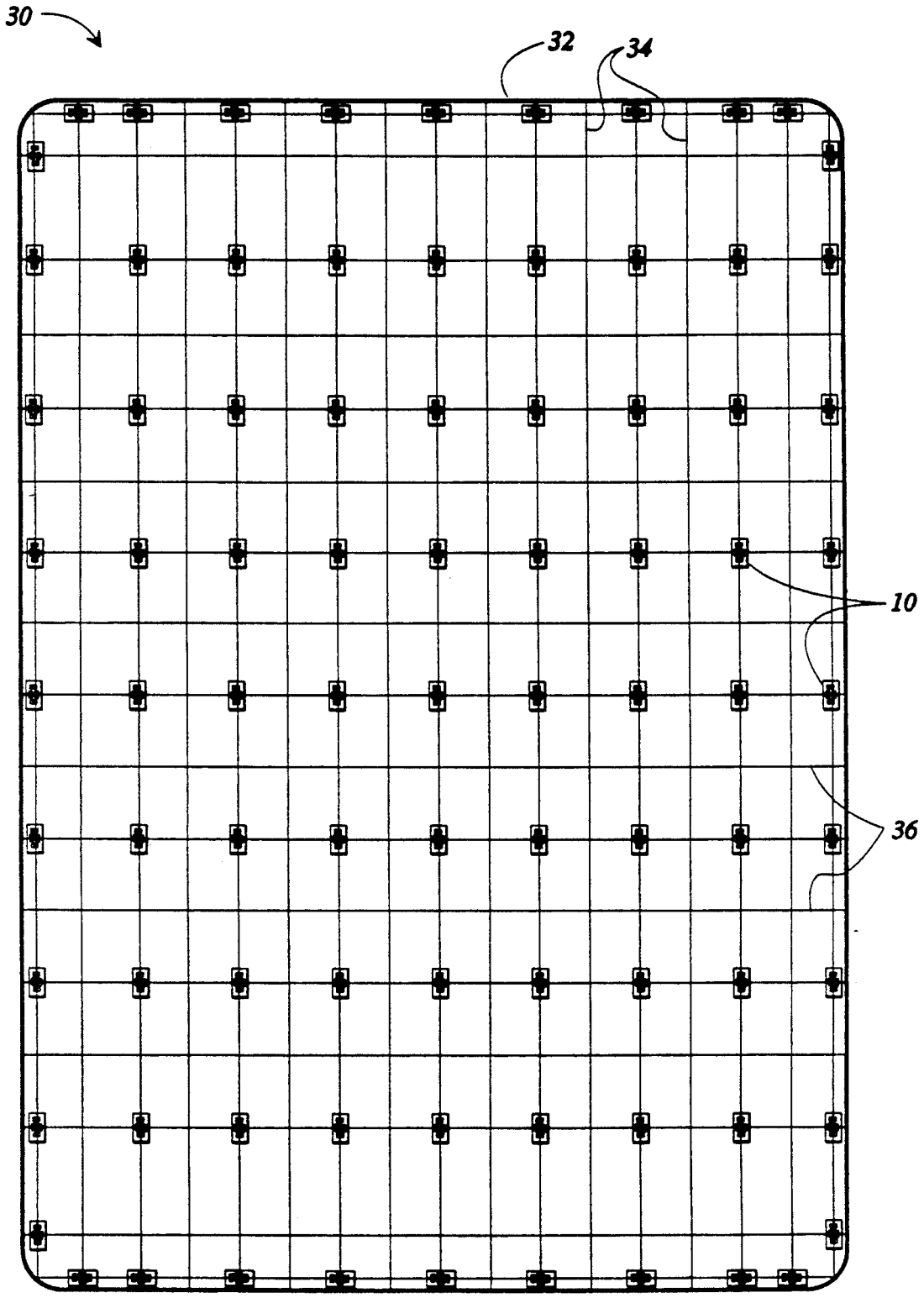
FIG. 3 is a top plan view of a first embodiment of a grid and spring combination.
Figure 7:
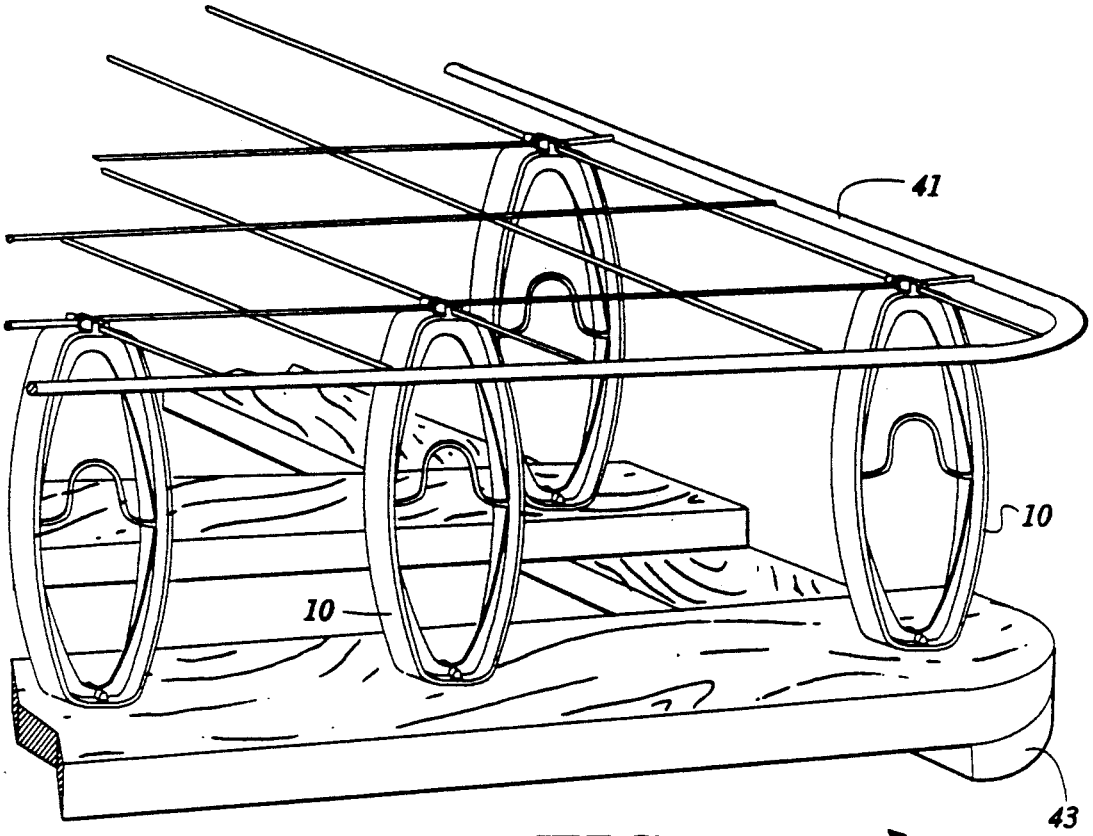
FIG. 7 is a pictorial view of the interior elements of a box spring according to the present invention, illustrating the interaction of a grid, spring, and a slat base.

Referring now to FIG. 3, one configuration illustrating a plurality of springs 10 in connection with a grid 30 is illustrated. Referring now also to FIG. 7, one configuration illustrating the connection between springs 10 and a grid 30 is illustrated. As shown in FIG. 7, the snap fitting attachment configured positioned at the top of each spring 10 is configured to be attached to the grid 30 in a snap-fitting relationship.

The grid 30 includes an outer border wire 32 which is generally rectangular in shape. Within this rectangular perimeter, a plurality of lengthwise inner wires 34 and transverse inner wires 36 extend in a crisscrossing relationship, such that the longitudinal axes of the lengthwise inner wires 34 are substantially coparallel to each other and perpendicular to the longitudinal axes of the transverse inner wires 36.

Each of the springs 10 are attached to the grid 30 approximate the intersection of the longitudinal and transverse inner wires 34, 36. In some snap-fit configurations contemplated, a snap-fit attachment is made to each of the two intersecting wires. In other snap-fit configurations, only one of the intersecting wires is engaged by a snap-fit, while the other wire is used to locate the spring in place and to prevent the spring from twisting.

The Springs, Grid, and Base

Figure 6:
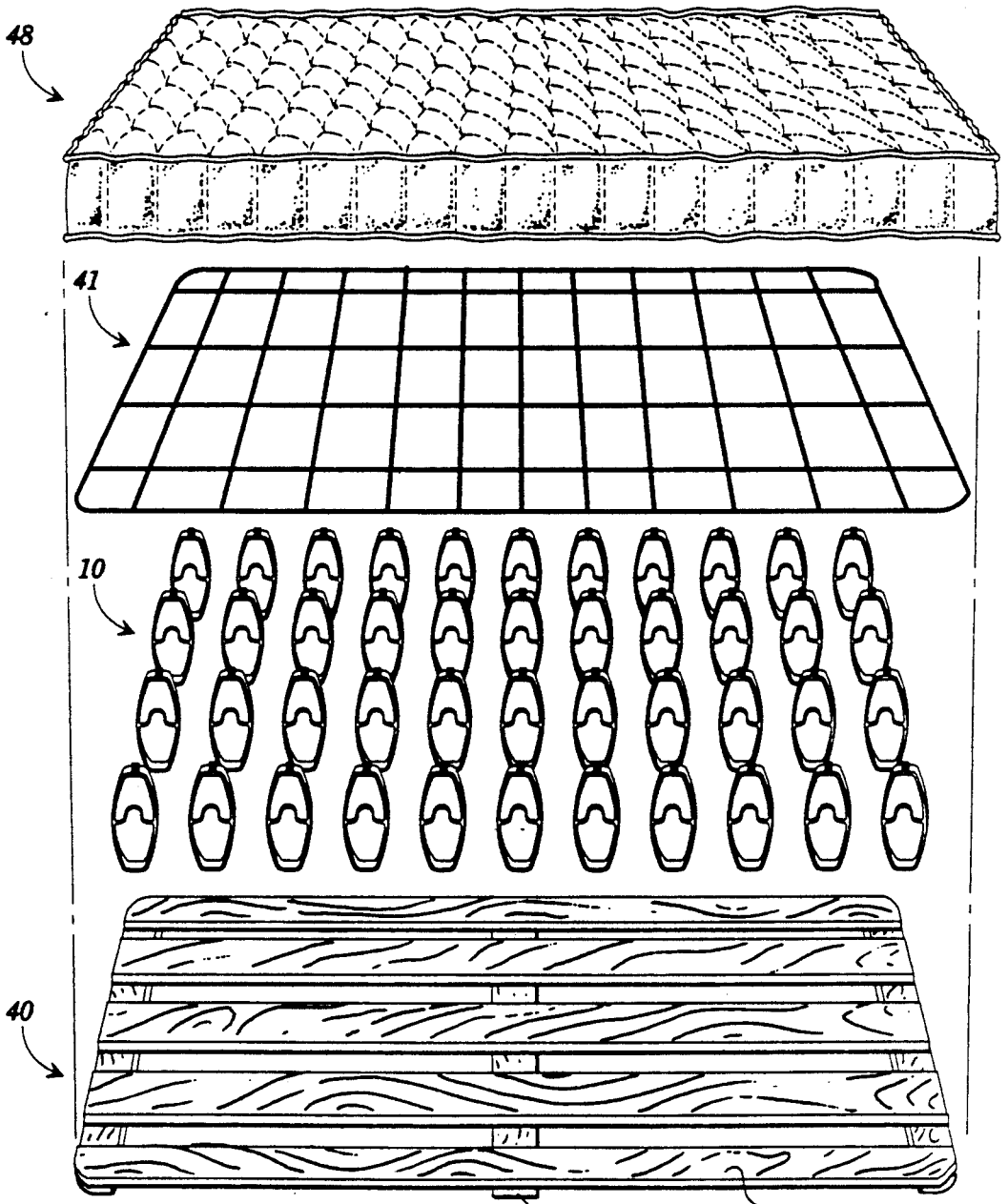
FIG. 6 is an exploded view of the interior components of a box spring for positioning beneath a mattress.

Referring now to FIGS. 6 and 7, the general configuration of the a preferred embodiment of a box spring according to the present invention, with a typical mattress situated thereupon, is illustrated. A wooden rack base 40 has a plurality of upper slats 42 lying in a crisscross manner relative to a plurality of lower slats 43. The upper slats 42 are substantially coparallel to each other, and substantially perpendicular to the lower slats 43. The slat sets are attached to each other by nailing, stapling, screwing, glueing, a combination of the above, or by other means known in the art.

Figure 8:
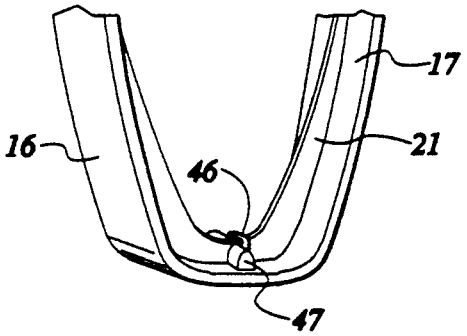
FIG. 8 is an isolated view of a lower portion of one of the springs, illustrating a manner in which the spring may be stapled to a base.

As described above, a plurality of springs 10 are attached to a wire grid 41 by a snap-fitting configuration. These same plurality of springs 10 are positioned atop the slat base 40, such that the springs are positioned atop the top slats 42. Referring now also to FIG. 8, the lower ends of the springs are attached to the top slats 42 by one or more staples 46, which pass through the lower end of each of the springs and are positioned on either side of a locater ridge 47 defined in the lower end of each spring 12, such that the staple fixes the bottom of each spring 10 to the slat base 40.

Once the grid, spring, and base are positioned together, cover materials (not shown) such as that known in the art are provided to encapsulate these and other elements in order to provide an ascetically pleasing box spring unit. A mattress 48 (see FIG. 6) may be positioned atop the completed box spring as desired.

Figure 29B:
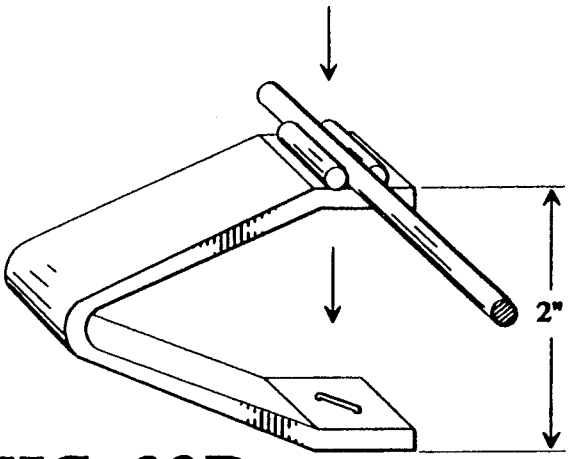
FIGS. 29A–B are pictorial views of a V-shaped spring in various stages of compression.
Figure 29A:
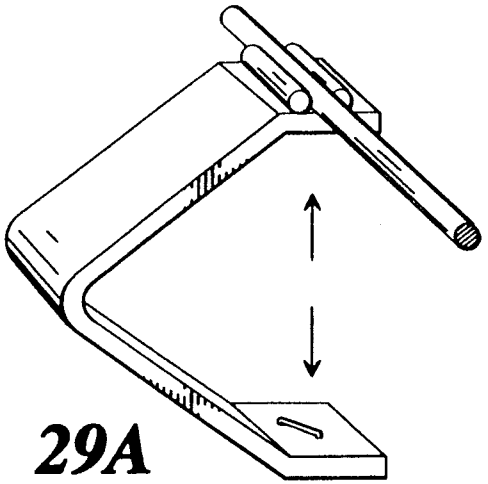
Figure 30:
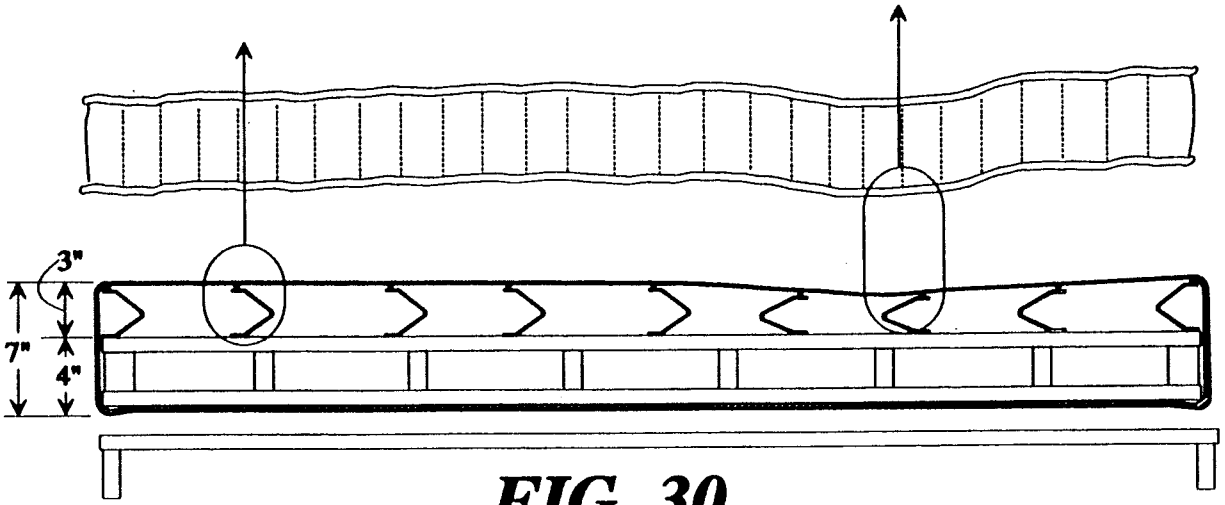
FIG. 30 is a side exploded partial cross sectional view of mattress/box spring/frame bedding system including the springs of FIGS. 29A–B in the box spring.

Reference is now made to FIGS. 29A–B, and 30, which illustrate alternate V-shaped plastic spring members snap-attached at upper ends to grid wire and stapled to a slat of a base member at their lower ends. It may be understood that the configuration of the V-shaped plastic spring members allows them to be extruded, with the individual springs being created after the extruded member is transversely cut at selected intervals. A wire clasp attaches the grid wire to the spring.

Alternate Spring-Grid Configuration

Figure 4:
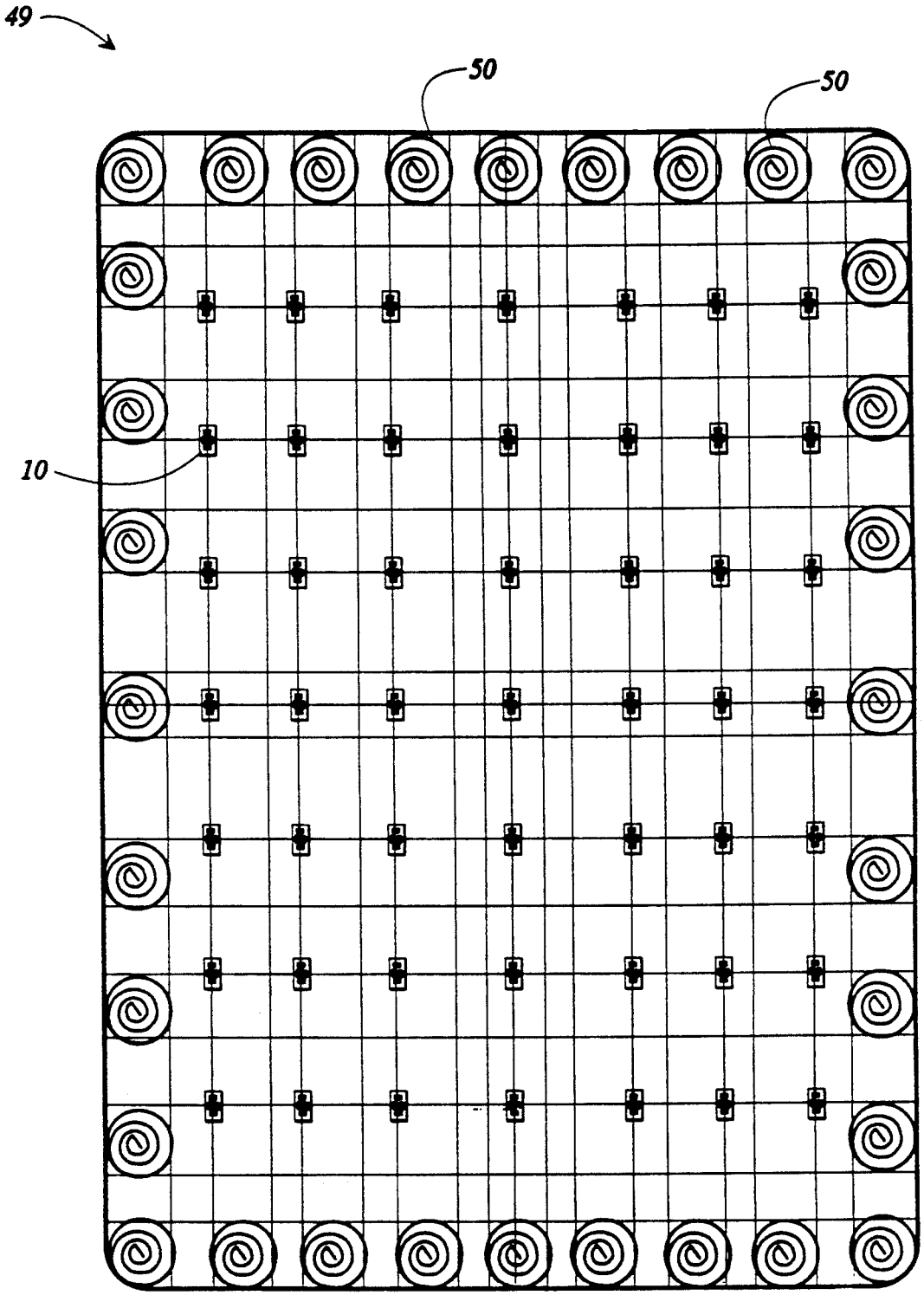
FIG. 4 is a top plan view of a second embodiment of a grid and spring combination.

Referring now to FIG. 4, an alternate preferred embodiment 49 of a portion of a box spring according to the present invention is illustrated. This embodiment is similar to that shown in FIG. 3, except that a plurality of open-coil springs 50 are positioned at the outside perimeter of the metal grid. These open-coil springs are "hog-ringed" to the grid such as is known in the art.

The Snap-Fit Connections

Figure 5:
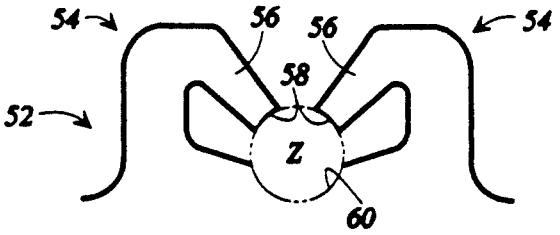
FIG. 5 is an isolated side plan view of a second snap-fit configuration.

As discussed above, FIG. 1 illustrates a first snap-fit configuration. Referring now to FIG. 5, a second embodiment of the snap-fit configuration 52 is provided to attach the tops of the springs 10 to a grid. This snap-fitting configuration 52 includes a pair of upwardly-extending members 54 each of which includes an inclined flange 56, each terminating in ends 58 having an arcuate configuration. It may be understood that a wire member having a substantially circular transverse cross-section may fit within a zone "Z", after the wire has been urged downwardly and "snaps" into position in zone Z such that the wire is in contact with arcuate portions 58 as well as arcuate lower portion 60 defined at the base of the configuration 52. The inclined flange members 56 restrict outward withdrawal of the wire member (not shown), as the wire member tends to abut against and be restricted by arcuate ends 58. It may be understood that if enough force is used in order to upwardly withdraw the wire from the snap-fitting configuration 52, the flanges 56 will eventually be deflected out of place.

It may be understood that the above members are used in combination with other members in order to attach one spring to one set of intersecting grid wires. One such combination is the use of four spaced-apart pairs of members 54 such that two pairs of members 54 engage one wire, and the other two pairs of members 54 engage another wire.

Figure 22:
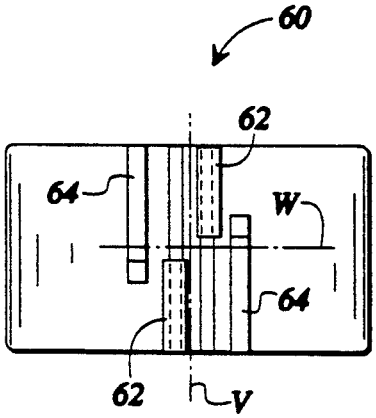
FIGS. 22, 23, and 24 are top, side, and front plan views, respectively, of a third embodiment of a snap-fit configuration.
Figure 23:
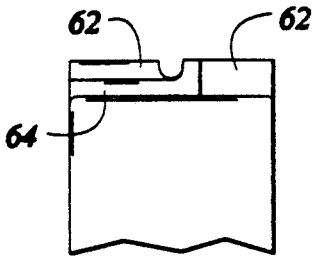
Figure 24:
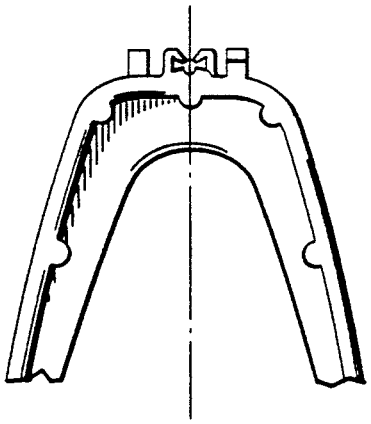

Referring to FIGS. 22–24, a third preferred embodiment 60 of a snap-fit configuration is illustrated. In this configuration, two upwardly-extending flanged members 62 combine with a base 64 in order to capture one of the crisscrossing wires (not shown) such that its longitudinal axis is substantially along axis V (illustrated in FIG. 22). Another pair of locating members 64 are also used, not to capture a wire, but to abut it such that it is located along axis W, such that the spring 10 will not twist or slide within the snap-fit.

It may be understood that, in this preferred embodiment, the wire crisscrossing members of the grid are metal, and the material making up the snap-fitting connection is made out of a plastic. The use of these two materials tends to reduce the potential for "squeaks", a significant advantage in that mattress or box spring users desire their mattresses or box springs to be squeak-free.

The Corner Guards

Figure 9:
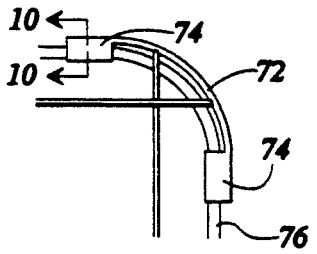
FIG. 9 is a top plan view of a portion of a grid according to the present invention, illustrating a corner guard according to the present invention snap-attached to the grid.
Figure 10:
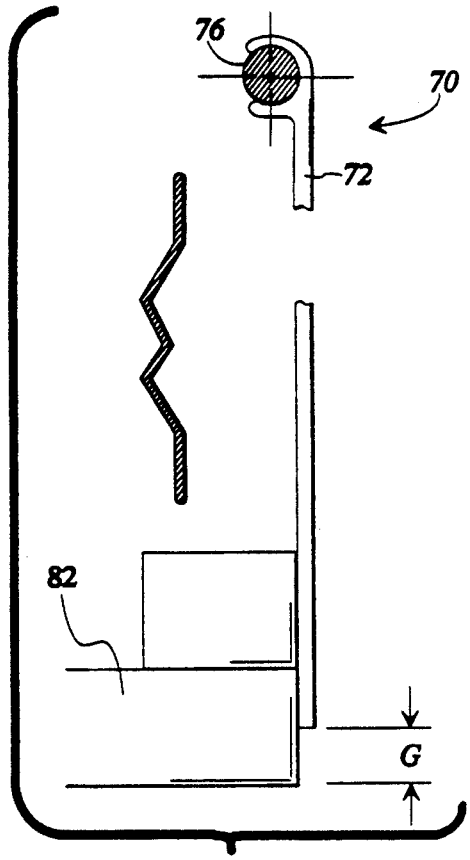
FIG. 10 is a cross sectional view of the corner guard illustrated in FIG. 9. It may be noted in FIG. 10 that two alternate wall configurations are shown, one configuration having a substantially smooth wall portion 72, and an alternate configuration having a plaited wall portion, which allows for deflection.
Figure 11:
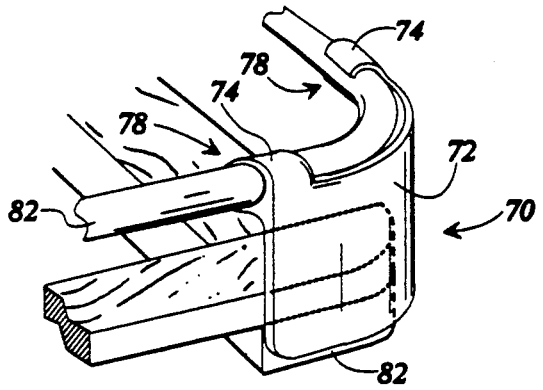
FIG. 11 is a pictorial view of the corner guard in place.

Referring now to FIGS. 9, 10, and 11, a "corner guard" according to the present invention is illustrated.

This corner guard 70 is configured of plastic such as nylon, polypropylene, or other synthetic materials and may be of unitary or multiple-part construction. The corner guard 70 includes a wall portion 72, and two snap-fitting flange portions 74, each of which are configured to attach to the border wire 76 at 78 (see FIG. 11).

As shown in FIGS. 10 and 11, the corner guard 70 extends downwardly from the border wire and partially covers the corner of a typical wood slat base 82, although a distance G is provided between the bottom edge of the wall and the lower surface of the slat base. This is to allow the corner guard to be deflected downwardly upon use of the mattress atop the box spring including the guard, without buckling. In FIG. 11, the springs and cross wires are not shown. The two flanges 74 of the corner guard 70 are configured to snap-fit over the corner of the border wire. Once in place, the corner guard provides a smooth outer arcuate surface, which, when covered with fabric, provides a smooth, aesthetically pleasing, corner to the box spring. It may be understood that this is a significant improvement over prior-art configurations, which basically involve stuffing cotton, scrap cloth, or other fibrous material at the corners in order to prevent the upholstery material from "caving in" during use of the box spring.

An alternate wall design is illustrated in FIG. 10, which contemplates the use of a plaited section which may allow for deflection of that portion of the wall. In this configuration, the lower edge of the corner guard may be stapled to the wood frame, such that downward movement of the border wire causes the plaited portion to deflect.

The Flexible or "Floating" Edge

Figure 12:
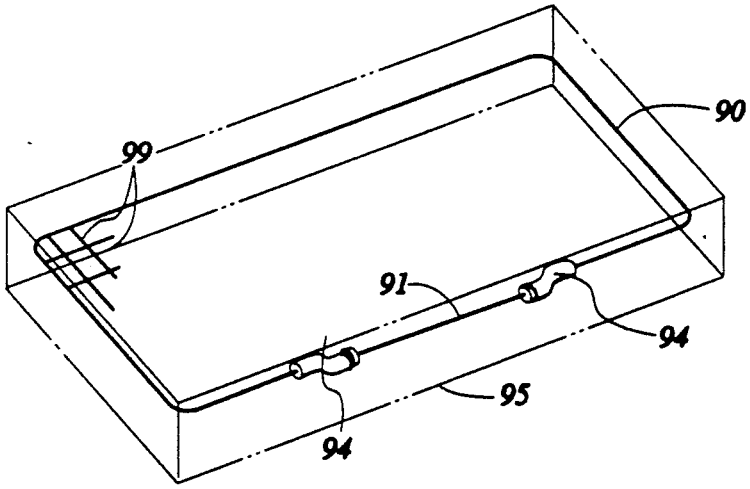
FIG. 12 is an illustrated view of a portion of the interior of a box spring according to the present invention illustrating a deflectable edge portion.
Figure 13:
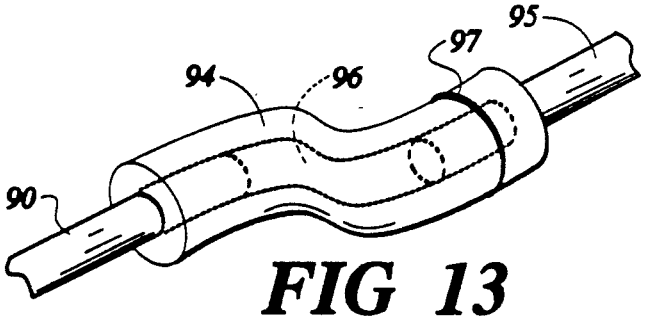
FIG. 13 is an isolated detailed view of a flexible tube positioned within a portion of the perimeter boarder wire illustrated in FIG. 12.
Figure 14:
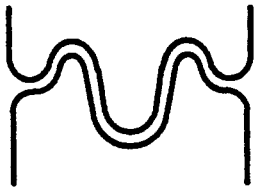
FIGS. 14–21 illustrate alternate membranes for use in springs such as that shown in FIG. 1.
Figure 15:
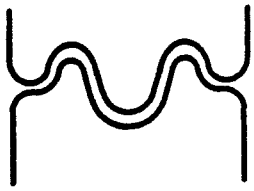
Figure 16:
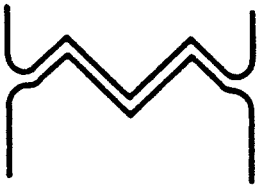
Figure 17:
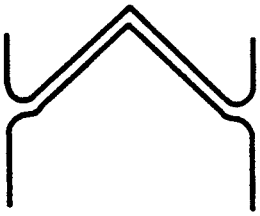
Figure 18:
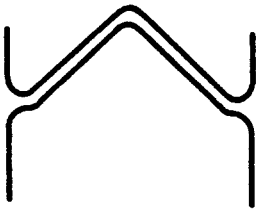
Figure 19:
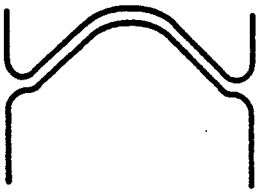
Figure 20:
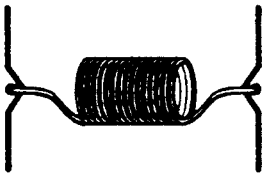
Figure 21:
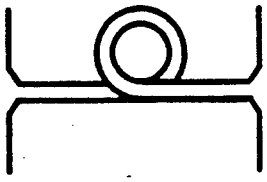

Referring now FIGS. 12 and 13, a alternative embodiment of the border wire 90 used in the box spring is illustrated. Once again, this border wire 90 is substantially rectangular in shape, but is of multi-piece construction, namely including a large "C"-shaped main portion, a "floating" side portion 91, and a pair of flexible tubes 94 which provide interconnection between the ends of the "C"-shaped portion and the ends of the floating portion. Referring now also to FIG. 13, one of the ends of each flexible tube is affixed to one end of the floating portion 95 by a clamp 97 or other suitable means. The other end of the flexible tubes accepts one end of the "C"-shaped portion in a "free-floating" manner, such that the end of the "C"-shaped portion can slide within the inner cavity 96 defined by each tube 94.

If a load is placed above the floating portion, it will deflect downwardly relative to the C-shaped portion. This is especially effective when two box spring units are used beneath one mattress, such as is the case with "king" size units. The box spring units can be placed side-to-side such that the floating portions 91 are adjacent to each other. This arrangement reduces the "ridge" effect that often occurs when the border wires of two box springs are adjacent when beneath a king size mattress, the "ridge" being felt in the center of the mattress.

It may be understood that the above two-piece border wire configuration may be provided by cutting a completed rectangular border wire such as is shown in the previous drawings. During the cutting, a short section of wire may be removed at each cut location, depending on the amount of space desired between the ends of the respective members.

It may also be understood that the present invention contemplates the use of no interconnecting tubes; it may be desirable alternatively to support the floating wire section by attaching it to springs or other members by hog rings, or stability may be provided simply by the presence of the crisscrossing inner wires previously discussed, shown generally as 99 in FIG. 12.

Borderwireless Mattress

Figure 26:
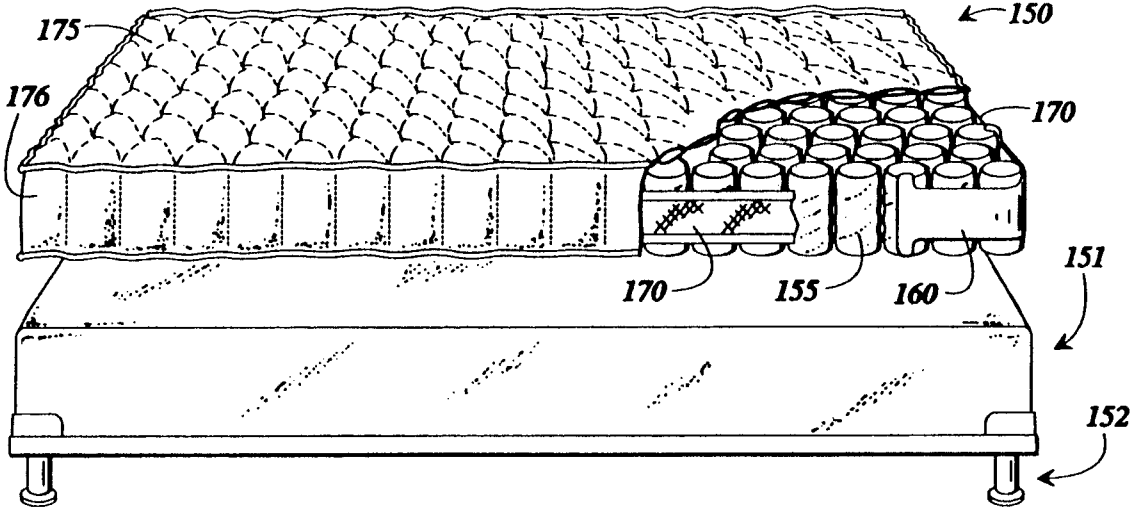
FIG. 26 is an exploded pictorial view of a border-wireless mattress atop a typical box spring and frame.
Figure 27:
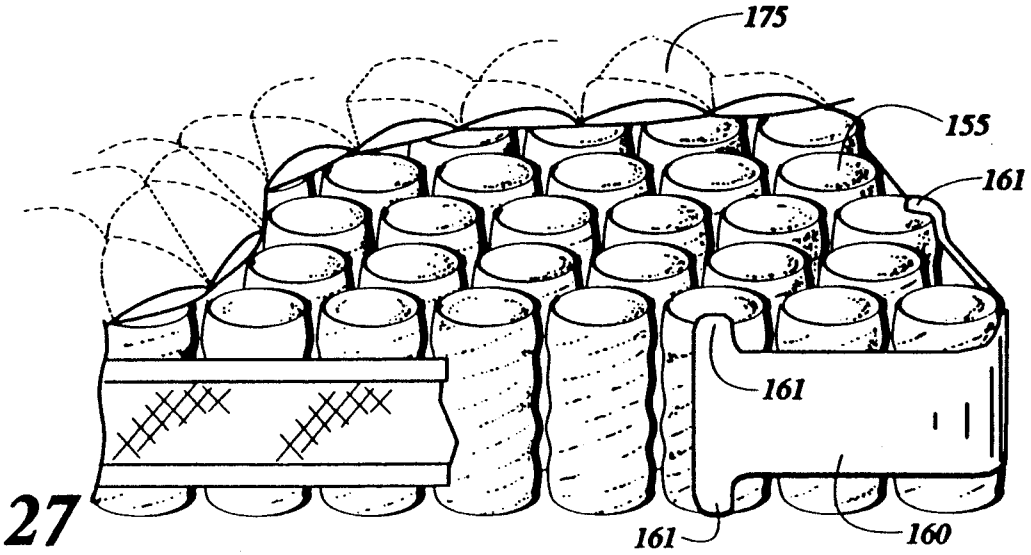
FIG. 27 is a close up view of a portion of FIG. 26.
Figure 28:
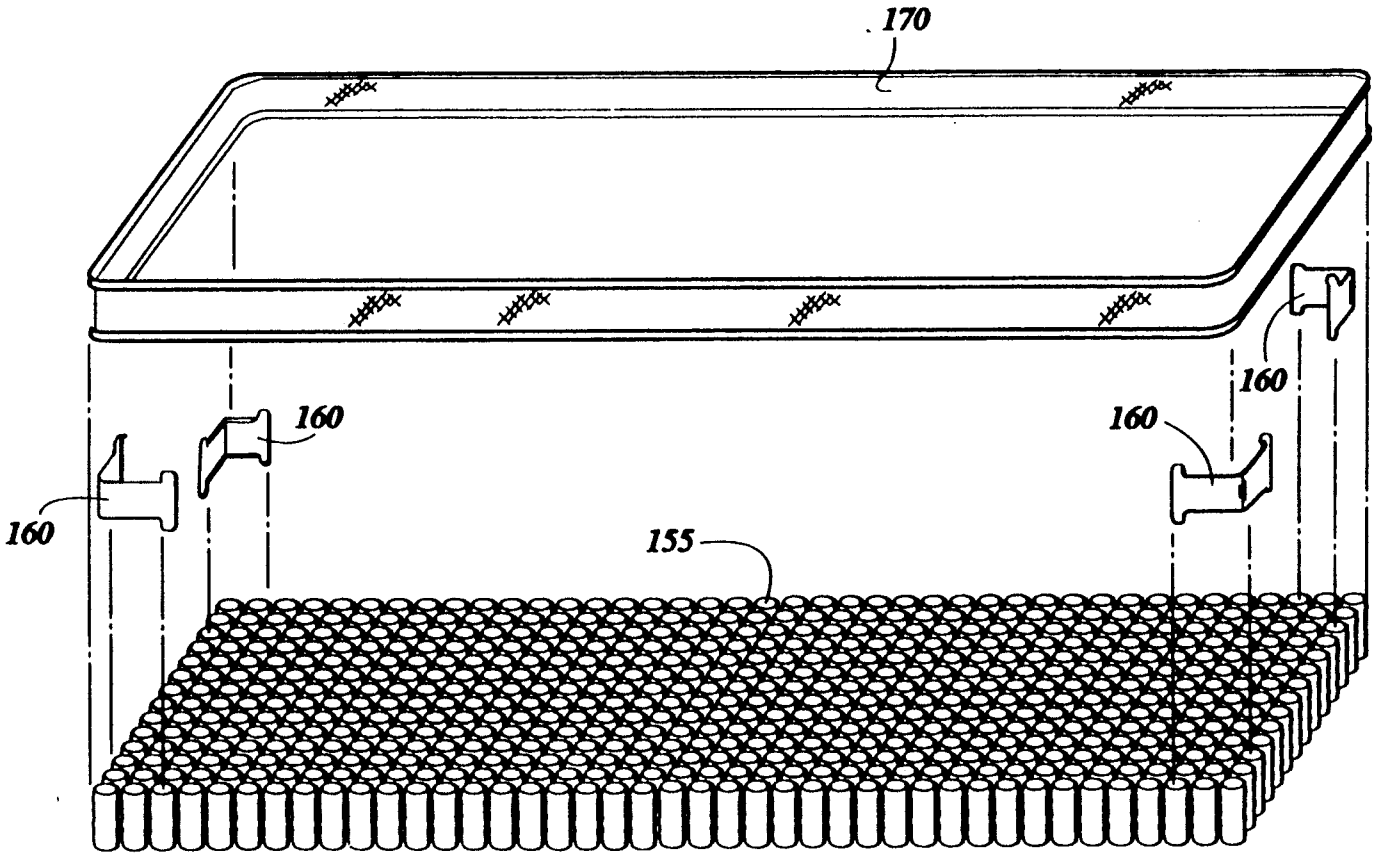
FIG. 28 is an exploded view of a portion of the interior of the mattress of FIG. 26.

Referring now to FIGS. 26–28, a mattress configuration 150 is illustrated atop a typical box spring 151 and frame 152. The mattress assembly 150 includes an innerspring subassembly 155, four corner members 160 and a perimeter band 170.

The innerspring subassembly 155 is composed of a plurality of elongate pocketed coil strings, having substantially parallel longitudinal axes, which are attached together by hot melt glue or the like. Examples of such pocketed coil innerspring assemblies are set forth in, for example, FIG. 1 of U.S. Pat. No. 4,578,834, incorporated by reference. It may be understood that such constructions are typically "rectangular" in shape, and include rows and columns of pocketed coils.

The corner members 160 are positioned in place at each corner of the innerspring subassembly, and are hog-ringed in place at the tops and bottoms of coils at the outer perimeter of the innerspring subassembly at 161 (see FIG. 27). However, it may be understood that the corner members may be hog ringed at other locations along the springs, or may even be attached in other ways.

A containment band 170 is situated about the outer perimeter of the inner spring subassembly 155 and the corner members 160, such that the band 170 squeezes the subassembly 155 and corner members 160 such that they stay together.

Upper and lower quilting panels are secured in place by hog rings at every other coil. Upper panel 175 is shown in FIGS. 26 and 27. Such top and bottom panels tend to provide additional structural stability to the mattress assembly.

The band 170 may be of a fabric material, may be of a synthetic material, or may be of other configurations. It could have heat-shrink or other shrinkable characteristics. However, it is important to note that the band should have certain characteristics to allow it, when in place, to be flexible transversely (to allow comfortable use), but should provide controlled flexing along its length, in order to allow it to maintain a tensile state with the corner members and coils in place.

The corner members may be made out of synthetic material such as plastic or rubber, or could also be made of other materials sufficient to provide structural integrity at the corner positions of the inner spring construction. A feature to note is that the corner members have somewhat more rigidity than the perimeter band.

Assembly of the mattress assembly 150 is as follows. An innerspring construction or subassembly 155 is situated atop an assembly table (not shown), such that the corner members 160 are in their respective positions. Pressure plates (not shown) are then activated to put pressure on the outermost sides of the outermost pocketed coils (head, foot, and each side), such that the inner spring construction subassembly is radially compressed somewhat, or "sized". This compression causes the outermost coil periphery to move toward the center of the innerspring construction, causing all of the coils, or at least the outer coils, to "tighten up" somewhat, such that the innerspring construction is shorter and narrower than in its relaxed, noncompressed state. It may be understood that the compression axes of the coils are not compressed. At this time, the peripheral band 170 is positioned about the innerspring subassembly and the corner members. Subsequently, the pressure bars are disengaged, causing the pocketed coils to expand somewhat such that the band is placed in a tensile state. It may be understood that the corner members, which in a preferred embodiment are plastic, allow for improved sliding of the band into place.

After the band is in place, hog rings are then attached to the upper and lower edges of the band to every other outermost coil (alternating with the hog ring attachments to be made to the upper and lower quilting panels). In the embodiment shown in FIG. 26, the fabric would be attached to the "second convolutions" of the coils relative to their upper and lower ends. However, in an alternate embodiment, the band width would approximate the height of the coils, and therefore the upper and lower edges of the band could be hog-ringed the to upper and lowermost portions of the coils, i.e. the "first" convolution at each end.

After the band is in place, the upper, lower, and border upholstery panels may be put in place. As previously discussed, the upper and lower quilting panels are hog-ringed at every other exterior pocketed coil, with alternating hog-ring connections being made to the band. Therefore, it may be understood that if a particular exterior pocketed coils is hog-ringed to the band, its adjacent exterior coils will be hog-ringed to the upper and lower panels.

Alternative configurations are contemplated under the present invention. For example, instead of providing a continuous band around the innerspring subassembly and corner members, the corner members could be linked together at their edges, thus obviating the need for a band to surround them. Such linkage could be done with string, cord, or materials described above for use as band material.

Furthermore, firmer coil springs could be used about the perimeter of the innerspring subassembly. For example 13½ gauge wire could be used along the outermost two rows of coils about the edge of the mattress, to provide firm side, head, and foot edges to the mattress, enhancing structural stability at the edges. 14½ to 16 gauge wire could be used in the center portion. In such an embodiment, an innerspring construction would be provided by gluing or otherwise fastening a plurality of elongate pocketed coil strings such that the strings run head-to-toe along the length of the mattress. On each side of the mattress, two "firm" pocketed coil strings would be provided. The pocketed coil strings between these "firm" strings would include "softer" coils except for two "firm" coils at each end. The resulting construction is an innerspring construction or assembly having a perimeter of "firmer" coils two rows deep about its perimeter.

It may be understood that although a mattress construction 150 is described above, similar configurations could be used for cushions, such as those used in furniture, automobiles, or aircraft. All such configurations provide improvements over the known prior art by providing a mattress which may be more easily "bent", which is often necessary when bed clothes are changed or the mattress is used with an adjusting foundation. Setting may also occur when a localized load is placed on the mattress edge by sitting; such a borderwireless mattress reduces such setting.

Conclusion

Therefore it may be seen that the present invention provides an improved spring which may be used in cushions, mattresses or box springs, which includes a limiting internal member, which assists in limiting the longitudinal deflection of the springs. Also provided are snap-fitting connections between the spring and a grid for use within a box spring. The invention also provides a deflectable "floating" portion of a peripheral border wire, which is especially suitable for use in a pair of box springs beneath a king-size mattress unit. The invention also provides a corner guard which provides support for covering thereon. The corner guard may include a plaited portion which accommodates deformation. Finally, the invention provides an improved borderwireless mattress using a peripheral band, allowing the mattress to bend move easily, without disadvantageous setting of border wires.

What is claimed is:

1. A box spring for supporting a mattress, comprising:

a base;

a wire grid including a perimeter border wire having at least one corner;

at least one coil spring for supporting said border wire above said base;

upholstery material at least partially covering said mattress at the location of said border wire corner; and a corner guard member attached to said border wire at said corner, said corner guard positioned underneath said upholstery material for support and defining a smooth curved surface for contact with said upholstery material.

2. The mattress supporting structure as claimed in claim 1, wherein said corner guard is attached to said border wire by a snap-fitting attachment.

3. The mattress supporting structure as claimed in claim 2, wherein said corner guard moves relative to said base when said grid is deflected downwardly.

4. The mattress supporting structure as claimed in claim 1, wherein said corner guard is attached to said base by stapling, such that said guard is deformed when said grid is deflected downwardly.

5. The mattress supporting structure as claimed in claim 4, wherein said corner guard includes a plaited wall.

* * * * *